United States Patent [19]

Wallander

[11] 3,946,442

[45] Mar. 30, 1976

[54] HELMET VISOR

[75] Inventor: Bengt Olof Henrik Wallander, Stockholm, Sweden

[73] Assignee: Conort Engineering AB, Stockholm, Sweden

[22] Filed: Sept. 20, 1972

[21] Appl. No.: 291,619

[30] Foreign Application Priority Data

Sept. 22, 1971 Sweden ..... 11987/71

[52] U.S. Cl. ..... 2/9

[51] Int. Cl.[2] ..... A61F 9/06

[58] Field of Search ..... 2/8, 9, 4, 5, 6, 14 R

[56] References Cited

UNITED STATES PATENTS

| | | | |
|---|---|---|---|
| 1,994,103 | 3/1935 | Huey | 2/8 |
| 2,259,680 | 10/1941 | Caudell | 2/8 |
| 2,485,117 | 10/1949 | Settle | 2/9 |
| 2,631,287 | 3/1953 | Malcom, Jr. | 2/9 |
| 2,687,523 | 8/1954 | Bernhardt | 2/8 |
| 2,886,819 | 5/1959 | Uphoff | 2/14 R |
| 3,475,766 | 11/1969 | Raschke | 2/9 |
| 3,540,058 | 11/1970 | LoGiudice | 2/8 |

*Primary Examiner*—H. Hampton Hunter
*Attorney, Agent, or Firm*—Edward H. Loveman

[57] ABSTRACT

A helmet visor to be attached to the front of a crash helmet to protect the user's face and comprising a stiff support comprising a curved transparent plate covered by an antifriction layer and a movable film material extending across the user's field of sight. A supply roll of the movable film is rotationally mounted at one side edge portion of the support and a continuously or intermittently driven take-up roll is mounted at the other side edge portion of the support. When the film section within the user's field of sight has received sight restricting deposits the user actuates the driven take-up roll to draw the dirty film section out of the field of sight and introduce a fresh film section into the field of sight.

9 Claims, 3 Drawing Figures

HELMET VISOR

The present invention refers generally to a device for automatically removing sight restricting deposits from the sight field of a user, and the invention refers especially to a helmet visor for horse-drivers, motorcycle-drivers (especially motocross-drivers) and other persons being exposed to sight restricting dirtying during their work.

Especially horse-drivers and motocross-drivers are during their activity exposed to sight restricting dirtying caused by splashing of dirt from the horses and motorcycles next ahead respectively, especially during rain and on a wet track. Persons participating in such activities have previously tried to wipe dirt away from the used protective goggles by a wet towel, but such an operation has only resulted in dirtier goggles and sometimes the sight has been so heavily decreased that the driver has been forced to leave off his participation in the race since the sight has become too bad through the dirtied goggles. Some horse-drivers have sometimes been forced to refrain from starting due to irritated eyes. Some previous attempts using a plurality of protective transparent layers in connection with goggles wherein one layer after the other successively could be removed in order to eliminate sight restricting deposits have not been successful, mainly because the user's both hands are occupied during the driving and thus, he can not manage to carry out further operations requiring manual work. Complicated and expensive devices having water impinging on flat goggles and dried by wiper blades have also been tried giving a similar negative result. These drawbacks have resulted in the fact that no operating device for this purpose is available. Thus, there is an apparent need of a device according to the present invention, the aim of which is to provide a reliable device for eliminating the above mentioned drawbacks.

The present invention provides a helmet visor for horsedrivers, motorcycle-drivers and the like for automatical removement of sight restricting deposits from the user's field of sight, said helmet visor eliminating the previous drawbacks by the specific features described and defined in the attached claims.

Figure 1:
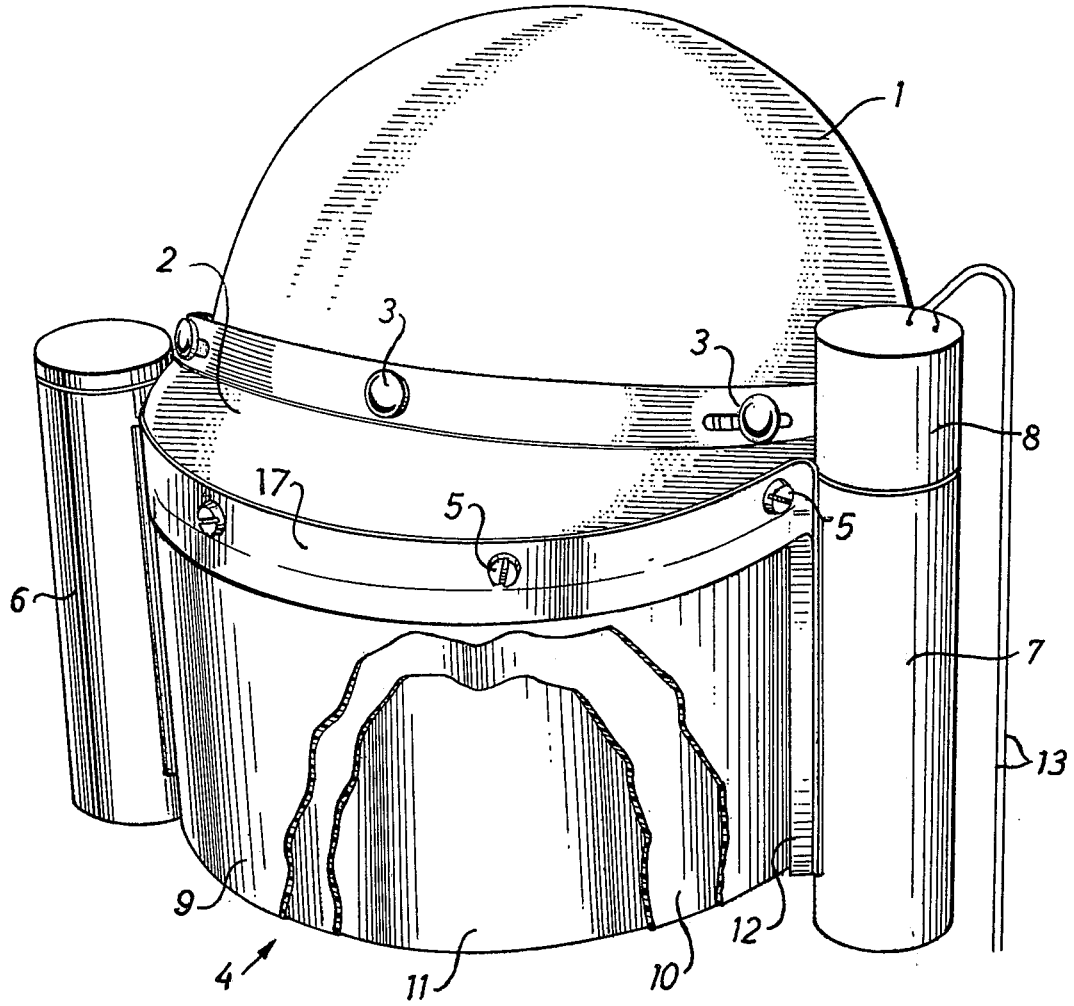
Figure 3:
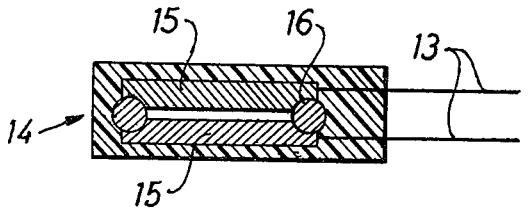
Figure 2:
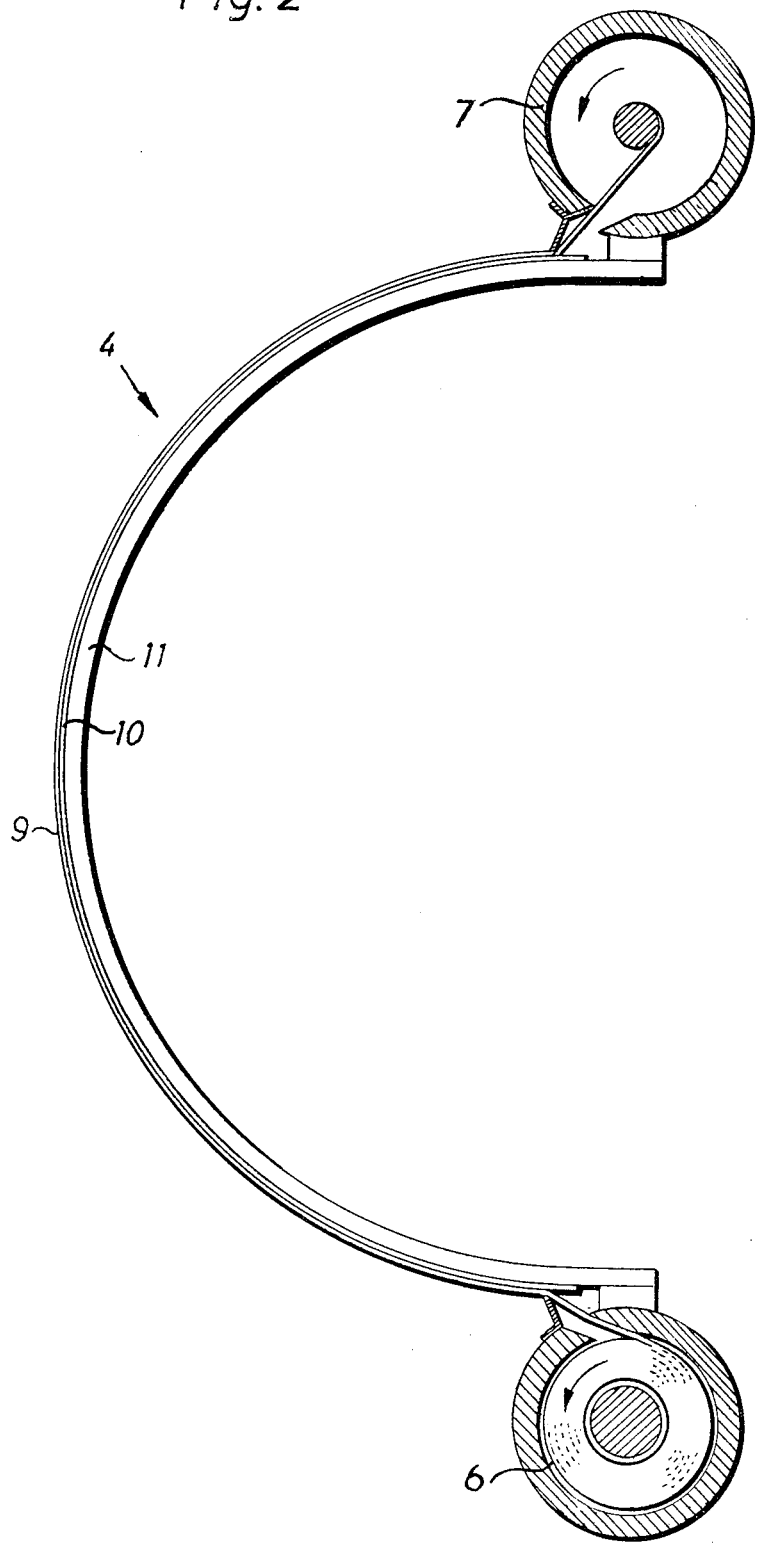

A preferred embodiment of the general invention defined in the claims will be described in detail in the following description and with reference to the attached drawings wherein FIG. 1 is a perspective view of the device according to the invention having a portion of the film material and a portion of a central antifriction layer broken away for the illustration of the layers behind, FIG. 2 is a sectional view (seen from underneath in FIG. 1) of the invention in a plane normal to the longitudinal axes of the rolls and substantially at the level wherein the eyes of the user normally are located, and FIG. 3 is a sectional view of a bite contact according to the invention for starting and stopping the power supply.

The embodiment of the invention illustrated on the drawings is intended to be releasably attached to a crash helmet 1 either directly or, preferably, via a helmet peak 2 attached to the visor according to the invention. In FIG. 1 the peak 2 is shown attached to the helmet 1 by screws 3 or the like, and the peak 2 is attached to the visor by screws 5 or the like. A protective strip 17 is provided outside the upper contact surface between the visor and the peak 2, said protective strip preventing water, dirt or the like to enter into the space between the layers of the visor.

The visor 4 comprises a transparent plate 11 made by a stiff resin material. A supply roll 6 provided with a thin transparent film material 9 is attached at one side edge portion of the plate 11, and a take-up roll 7 is attached to the other side edge portion of the plate 11. The transparent film material 9 is extended between these two rolls 6, 7 in a path from the supply roll 6 to the take-up roll 7, and this path is defined by the configuration of the stiff plate 11. In the shown embodiment the stiff plate 11 is bent to a configuration corresponding to the curved configuration of the front edge of the peak 2. However, the plate 11 may have other configurations, it may e.g. be flat, but in such a case a different attachment to the crash helmet 1 must be used. Additionally, the transparent film material 9 can be modified to move in another preferred path e.g. by way of vertically provided rods contacting the film material. In such a case the plate 11 as well as the below described antifrictional layer 10 may be deleted.

The supply roll 6 is provided in a surrounding casing and the film material 9 is discharged through an opening in said casing. The film 9 then extends over the transparent plate 11 and into a casing enclosing the take-up roll 7. An anti-frictional layer 10 is provided on the plate 11 in order to protect the plate from scratching or the like. Said layer may be a thin transparent protective film of a suitable resin material having low coefficient of friction.

The supply roll 6 is an idler roll but it is preferably provided with a brake, e.g. a rubber disc provided in the fixed casing of the supply roll, said rubber disc constantly contacting the cylindrical inside surface of the supply roll 6, and hence, the film material 9 will be tensioned in its path along the stiff plate 11 and pressed against the antifrictional layer 10. Any suitable type of brake for the supply roll 6 may of course be used.

The turning direction of the rolls have been indicated by arrows (FIG. 2) and the film material 9 is moving in FIG. 1 from the left side, i.e. from the supply roll 6, to the right side, i.e. to the driven take-up roll 7.

The take-up roll 7 is driven preferably by a motor 8, which in the presently preferred illustrated embodiment is a small electrical motor powered by an accumulator or a battery. The motor may either continuously operate to continuously feed the film material 9 from the supply roll 6, through the user's field of sight and onto the take-up roll 7, or the motor may be actuated upon demand to start the feeding of a new portion of the film material 9 into the place in front of the visor. In the embodiment shown on the drawings the motor may be actuated to start and stop the feeding. Leads 13 are at one end connected to terminals of the motor and at the other end to a bite contact 14 shown on the drawings to comprise contact plates or strips 15 connected to the leads 13. The contact plates or strips of the contact are in their non-activated condition spaced apart by distance means 16, said distance means being e.g. spring pieces, an O-ring or the like. A protective resilient casing is preferably provided around the bite contact 14, said casing being a portion of a rubber or resin pipe or the like.

A remover blade 12 is provided in front of the entrance opening of the casing enclosing the take-up roll 7 for removing a portion of the dirt deposited on the foil before the foil is wound onto the take-up roll.

An important feature of the invention is that the film material 9 extends to a predetermined distance below the transparent plate 11. By this feature the risk for drawing moisture by adhesion into the space between the film 9 and the plate 11 having the antifriction layer 10 is eliminated, which otherwise could occur. If moisture could enter into said space the moisture would expand and make the film 9 fasten onto the protective layer 10 and seriously effect the proper feeding of the film 9 and decrease the sight. The same effect, i.e. to prevent moisture to enter into contact with and be drawn into the space between the film and the plate is achieved at the upper edge by the protective strip 17 and at the side edges by side strips (the remover blade 12 of which being the only one indicated on the drawing).

The device according to the invention may preferably be manufactured and distributed as an auxiliary means for mounting on presently used helmets, since the visor is preferably mounted on a helmet peak being easy to attach to the helmet by the user himself. The used film material is so cheap that it is preferably disposable, i.e. when the supply roll 6 is emptied the take-up containing the used film material may be thrown away and a new roll provided with fresh film material may be mounted.

While the function of the device is extremely simple the operation thereof will be only briefly explained. When e.g. a horse-driver has received a visor according to the present invention he mounts it on his own helmet by the mounting screws 3 being present in every standard helmet for the mounting of the usual peak. Then the helmet is placed on the head of the user and the device is ready for operation. Before the start of the race the user puts the bite contact into his mouth in order later to be able to start and stop the motor without using his hands, which are occupied during the driving. When the sight after a while is decreasing due to deposition of sight restricting dirt upon the section of the film material positioned in front of the user's face, the user bites against the bite contact and the contact plates are brought into contact with each other and the electrical circuit is closed and the motor starts the feeding of the film material. When a sufficient amount of clean film has been drawn into the field of sight the user let the contact plates go apart and the motor stops. This operation is repeated whenever the section of the film material in the user's field of sight has become dirty and should be replaced.

In spite of the fact that a preferred embodiment of the invention has been described above and illustrated on the attached drawings, it is recognized that variations and modifications thereof can be made by the man skilled in the art within the scope of the invention as defined in the attached claims. Hence, the visor can be foldable in front of the user by any suitable means, the visor may be flat instead of curved, the supply roll and the take-up roll may be placed above and below respectively, the visor wherein the film material will extend mainly vertically instead of horizontally on the drawing, the feeding of new sections of film material can be manually operated instead of by a motor, and in case a motor is used it can drive the film either continuously or intermittently by starting and stopping the feeding by any suitable contact means. The embodiment shown and described is however considered to be the one presently fulfilling the requirements in the best way and also in the best way eliminating the previous drawbacks and difficulties.

What we claim is:

1. A visor apparatus for mounting to a helmet comprising:

a transparent support having a configuration corresponding to the shape of said helmet and located on said helmet in a field of a wearer of said helmet, a transparent movable film material extending in front of said wearer's field of sight, a supply roll mounted on one side of edge of said support and containing a new supply of movable film, and a take-up roll mounted on the other side edge of said support for receiving said film material after it has accumulated sight restricting deposits thereon and wherein an anti-frictional layer is provided between said transport film material and said support to avoid scratching of said support and/or said film material.

2. A visor apparatus as recited in claim 1, wherein said transparent support comprises a transparent plate of stiff resin material.

3. A visor apparatus as recited in claim 1, wherein said transparent film material extends a distance below said support.

4. A visor apparatus as recited in claim 1, wherein said take-up roll is driven and said supply roll is an idler roll.

5. A visor apparatus as recited in claim 1, wherein said takeup roll is driven by a motor upon demand by said wearer.

6. A visor apparatus as recited in claim 5, further comprising:

a contact means adapted to be placed in the mouth of said wearer and, a lead means connecting said contact means to said motor whereby said motor for feeding said transparent film material is actuable by said contact means.

7. A visor apparatus as recited in claim 1, wherein said transparent film is disposable.

8. A visor apparatus as recited in claim 1, wherein said helmet includes a peak and said transparent support is located directly below said peak said peak further including a protective strip depending from said helment peak in order to eliminate the risk for penetration of moisture, dirt or the like into the space between said film material and said support.

9. A visor apparatus as recited in claim 1, wherein a fixed wiper blade is provided in front of said take-up roll in order to scrape away deposits on said film material before said film material is wound onto said take-up roll.

* * * * *